US006654005B2

(12) United States Patent
Wang

(10) Patent No.: US 6,654,005 B2
(45) Date of Patent: Nov. 25, 2003

(54) LOW PROFILE JOY STICK AND SWITCH

(75) Inventor: Kart Wang, Kaohsiung (TW)

(73) Assignee: CTS Corporation, Elkhart, IN (US)

( * ) Notice: Subject to any disclaimer, the term of this patent is extended or adjusted under 35 U.S.C. 154(b) by 263 days.

(21) Appl. No.: 09/960,819

(22) Filed: Sep. 21, 2001

(65) Prior Publication Data

US 2003/0058220 A1 Mar. 27, 2003

(51) Int. Cl.[7] ..... G09G 5/08
(52) U.S. Cl. ..... 345/161; 200/6 A
(58) Field of Search ..... 345/161, 157, 345/168; 74/471 XY; 341/20; 200/612; 338/128, 131

(56) References Cited

U.S. PATENT DOCUMENTS

| | | | | |
|---|---|---|---|---|
| 3,394,611 A | | 7/1968 | Beurrier | |
| 4,325,050 A | | 4/1982 | Suszynski | |
| 4,375,631 A | | 3/1983 | Goldberg | |
| 4,490,710 A | | 12/1984 | Kopsho, Jr. et al. | |
| 4,559,420 A | | 12/1985 | Yamada | |
| 4,587,510 A | | 5/1986 | Kim | |
| 4,620,176 A | | 10/1986 | Hayes | |
| 5,229,742 A | | 7/1993 | Miyamoto et al. | |
| 5,473,325 A | | 12/1995 | McAlindon | |
| 5,823,057 A | | 10/1998 | Hsien | |
| 6,059,660 A | | 5/2000 | Takada et al. | |
| 6,078,247 A | | 6/2000 | Shimomura | |
| 6,307,486 B1 | * | 10/2001 | Takeda et al. | 341/20 |
| 6,353,430 B2 | * | 3/2002 | Cheng et al. | 345/161 |
| 6,538,639 B1 | * | 3/2003 | Takahashi | 345/161 |
| 6,580,418 B1 | * | 6/2003 | Grome et al. | 345/161 |

FOREIGN PATENT DOCUMENTS

DE 4123503 CE 4/1995

* cited by examiner

*Primary Examiner*—Regina Liang
(74) *Attorney, Agent, or Firm*—Mark P. Bourgeois

(57) ABSTRACT

A joystick has a base and a cover mounted over the base. A stick has a first end extending from the cover and a second end. A gimbal has a first and second yoke that are coupled to the stick to allow the stick to move. The yokes each have a first and second end. A pair of wipers is mounted to the first ends of the yokes. A pair of resistors is positioned between the wipers and the base. The resistors are adapted to generate an electrical output signal indicative of a position of the stick when a voltage is applied to the resistors. Several terminals are mounted to the base. A first portion of the terminals are electrically connected to the resistors. A switch is positioned in the base below the second end of the first yoke. The switch is activated when the first yoke is sufficiently rotated so as to cause the second end of the first yoke to contact the switch and to close the switch.

26 Claims, 7 Drawing Sheets

LOW PROFILE JOY STICK AND SWITCH

CROSS REFERENCE TO RELATED AND CO-PENDING APPLICATIONS

This application is related to the following U.S. patent applications: U.S. patent application Ser. No. 09/274,951, filed Mar. 23, 1999 and titled, "Gimbal Mounted Joystick with Z-axis Switch".

The foregoing patent has the same assignee as the instant application and is herein incorporated by reference in entirety for related and supportive teachings.

BACKGROUND OF THE PREFERRED EMBODIMENT(S)

1. Field of the Invention

This invention generally relates to a control device, like a pointing stick, for controlling the positioning, movement and operation of a responsive electrical device, like a cursor on a computer display screen. Specifically, there is a low profile joystick with a switch that can, for example, both direct a cursor on a screen and select items on the display screen by tapping on the pointing stick instead of clicking a mouse button.

2. Description of the Related Art

Various devices are well known for controlling cursor movement over a computer display screen of a computer and for signaling a choice of computer command identified by the position of the cursor on the display screen menu. The most commonly known devices are known as a "mouse" that has a ball on its underside rolled over a horizontal surface, with the x- and y-axis components of movement being sensed and transmitted through a connecting cable to a serial input port of the computer. The signal to the computer is varied by the amount and direction of movement of the mouse ball, and causes the cursor on the display screen to have a corresponding movement. One or two "mouse" or "click" buttons, located on the top of the mouse at the forward end, permit the computer operator to enter a selection or other command to the computer (the command typically being shown by the position of the cursor on a displayed menu) upon pressing one or the other or both buttons, depending upon the software associated with the device. Such a device, requires a flat, horizontal surface.

Another well known electrical controlling and signaling mechanism is a "joystick." The joystick is typically an elongated stick that extends upwardly from a base connected to the computer console by means of a cable. The joystick is operated by tilting the upstanding stick in various directions to cause the cursor or other display element to move in a direction and usually at a speed corresponding to the direction and pressure exerted on the stick by the computer operator. The operation of a joystick, however, frequently requires a separate button to be pushed, for example, to select icons on the screen.

Despite the advantages of each type of controller, none had, for example, allowed the user to both control a cursor movement and select items on the display screen using exclusively a single part of the device, namely a shaft, and being exclusively manipulated and activated by potentially using only one finger. Additionally, it is important to have an extremely low profile and small footprint, or small surface area used on a printed circuit board that has the joystick mounted thereon. Moreover, it is important to have as few parts to the design as possible, to reduce the complexity and cost of manufacturing. Finally, it is important that any joystick design have a centering position having the stick or main shaft pointing straight up when not in use. Most prior art designs have complex and costly methods of achieving the centering position. A current unmet need exists for a low profile joystick with a switch.

SUMMARY OF THE PREFERRED EMBODIMENT(S)

It is a feature of the invention to provide a joystick and switch for controlling the positioning, movement and operation of a responsive electrical device, like a cursor on a computer display screen.

A further feature of the invention is to provide a joystick that includes a base and a cover mounted over the base. A stick has a first end extending from the cover and a second end. A gimbal has the second end of the stick mounted thereto. The gimbal is located above the base. The gimbal has a first and second yoke that is coupled to the stick for allowing the stick to move. The yokes each have a first and second end. A pair of wipers is mounted to the first ends of the yokes. A pair of resistors is positioned between the wipers and the base. The resistors are adapted to generate an electrical output signal indicative of a position of the stick when a voltage is applied to the resistors. Several terminals are mounted to the base. A first portion of the terminals are electrically attached to the resistors. A switch is positioned in the base below the second end of the first yoke. The switch is activated when the first yoke is sufficiently rotated so as to cause the second end of the first yoke to contact the switch and to close the switch. The switch is electrically connected to a second portion of the terminals.

The invention resides not in any one of these features per se, but rather in the particular combination of all of them herein disclosed and claimed and it is distinguished from the prior art in this combination of all of its structures for the functions specified.

There has thus been outlined, rather broadly, the more important features of the invention so that the detailed description thereof that follows may be better understood, and so that the present contribution to the art may be better appreciated. There are, of course, additional features of the invention that will be described after this which will form the subject matter of the appended claims. Those skilled in the art will appreciate that the preferred embodiment may readily be used as a basis for designing other structures, methods and systems for carrying out the several purposes of the present invention. It is important, therefore, that the claims are regarded as including such equivalent constructions since they do not depart from the spirit and scope of the present invention.

BRIEF DESCRIPTION OF THE DRAWINGS

These and other features of the invention can best be understood by the following description of the accompanying drawings as follows.

It is noted that the drawings of the invention are not to scale.

DETAILED DESCRIPTION OF THE PREFERRED EMBODIMENT

Figure 1:
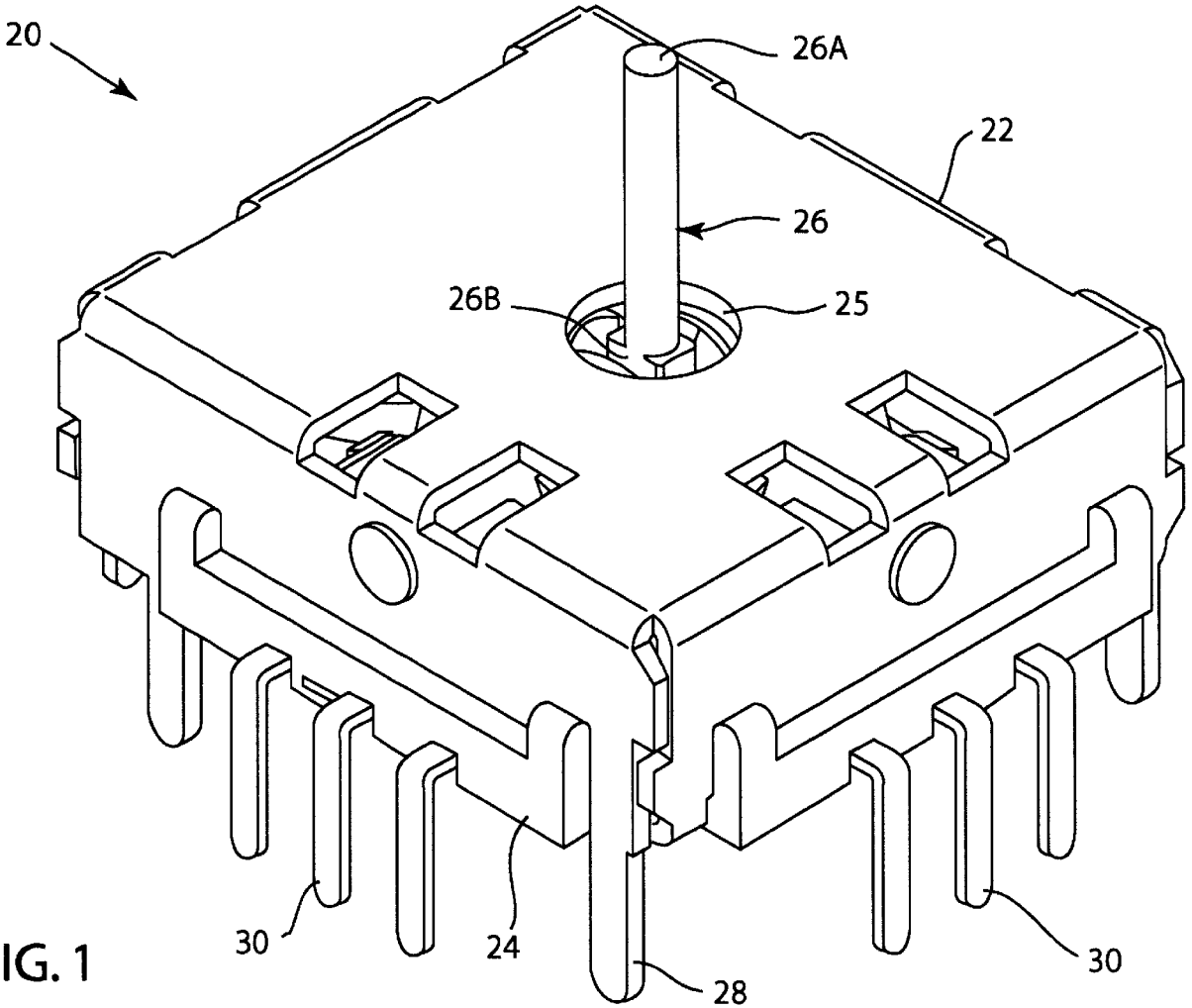
FIG. 1 is a perspective view of a joystick and switch of the present invention.
Figure 2:
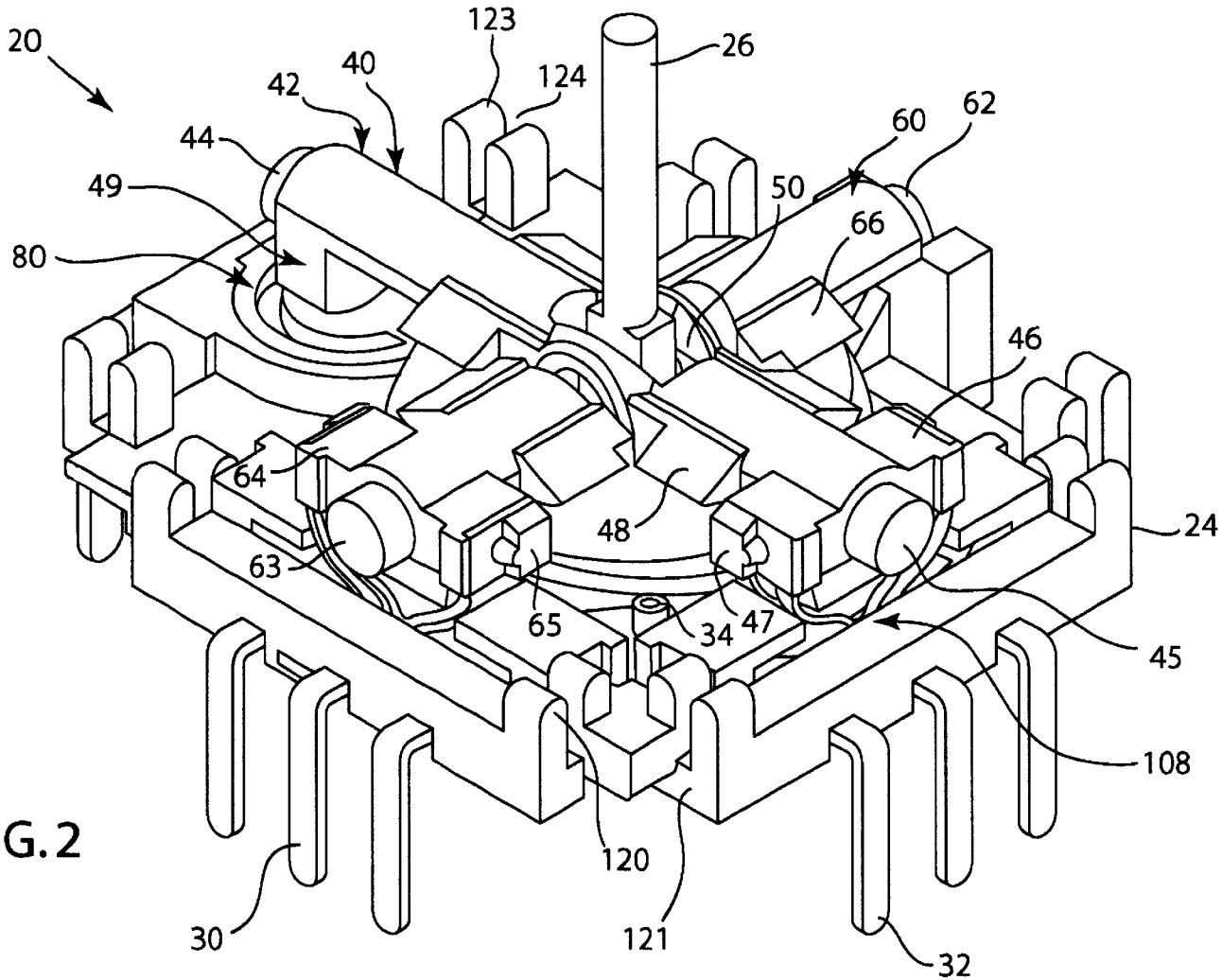
FIG. 2 is a perspective view of a FIG. 1 with the cover removed.
Figure 3:
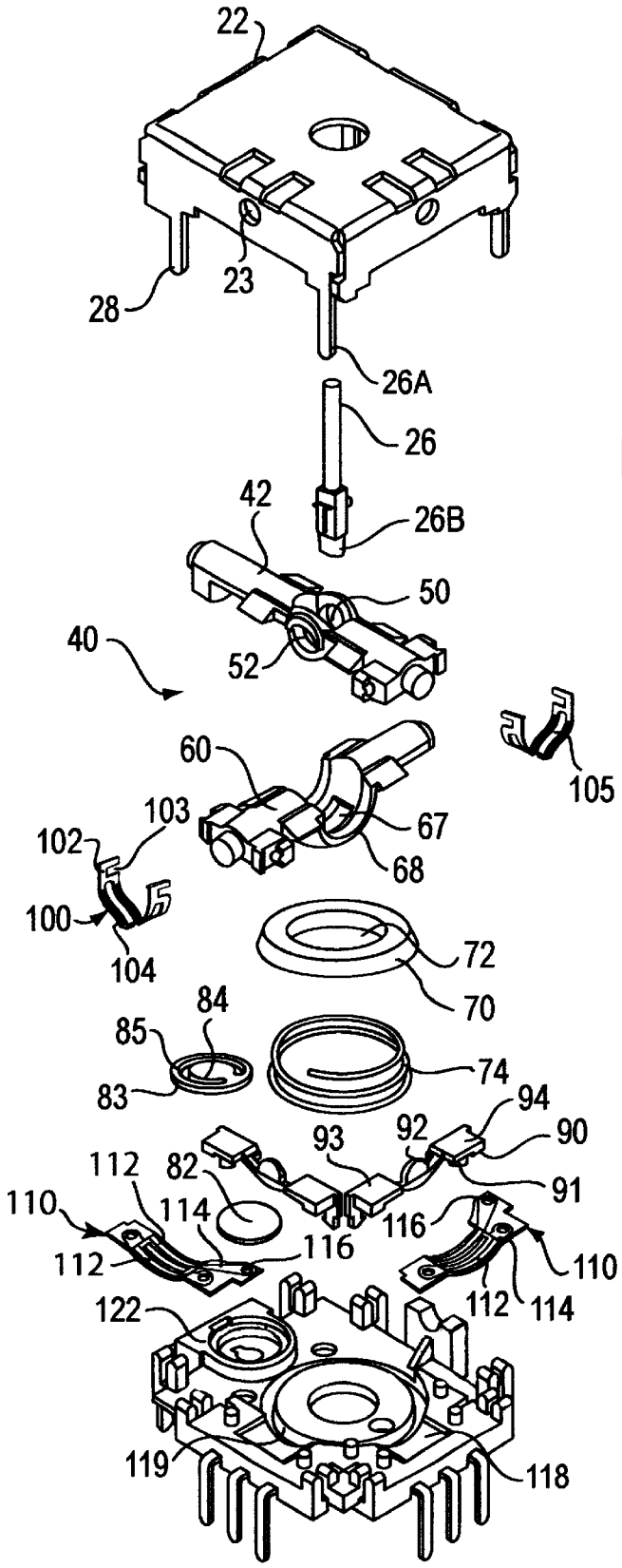
FIG. 3 is an exploded perspective view of a FIG. 1.
Figure 4:
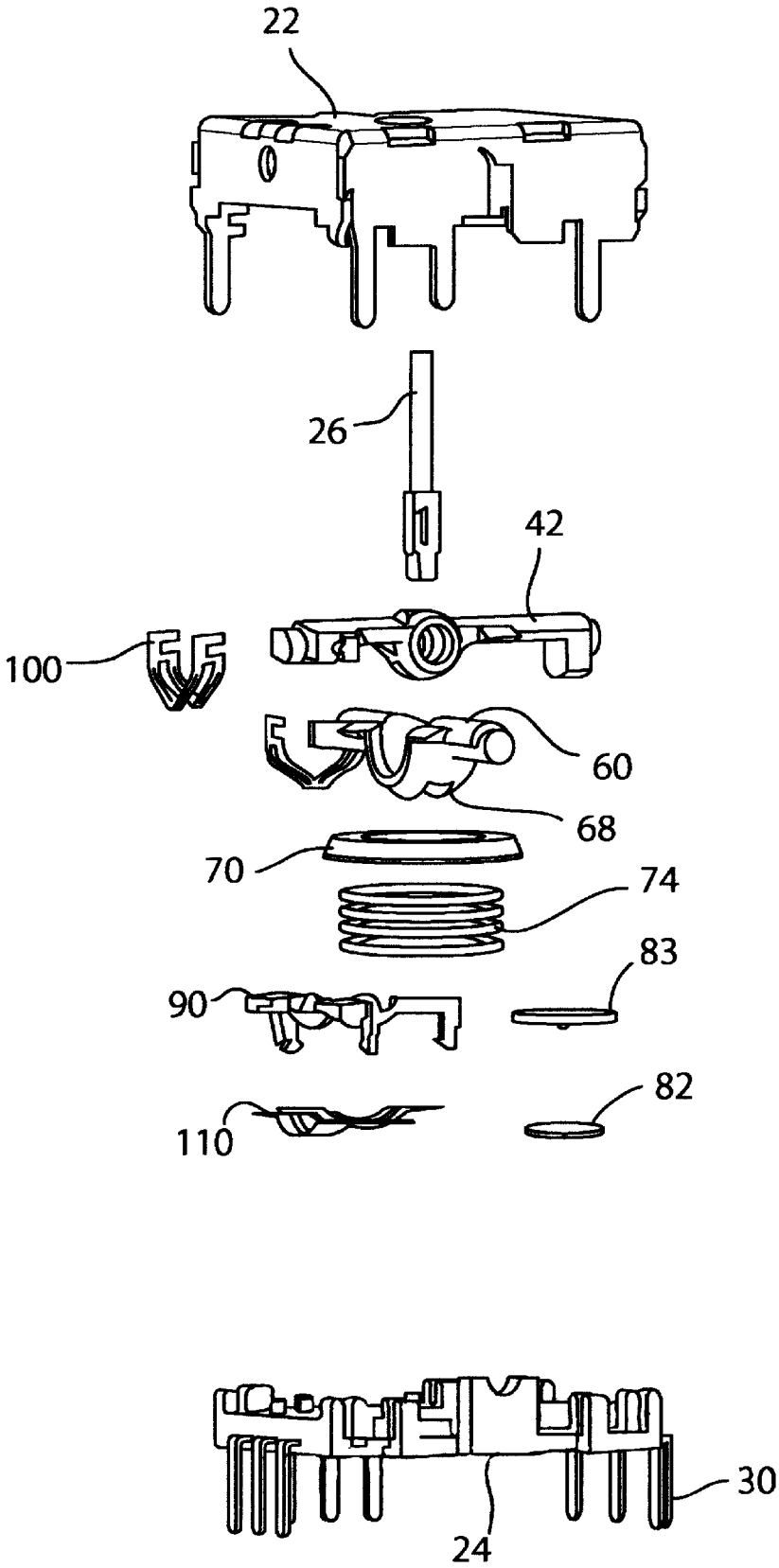
FIG. 4 is another exploded perspective view of a FIG. 1.
Figure 5:
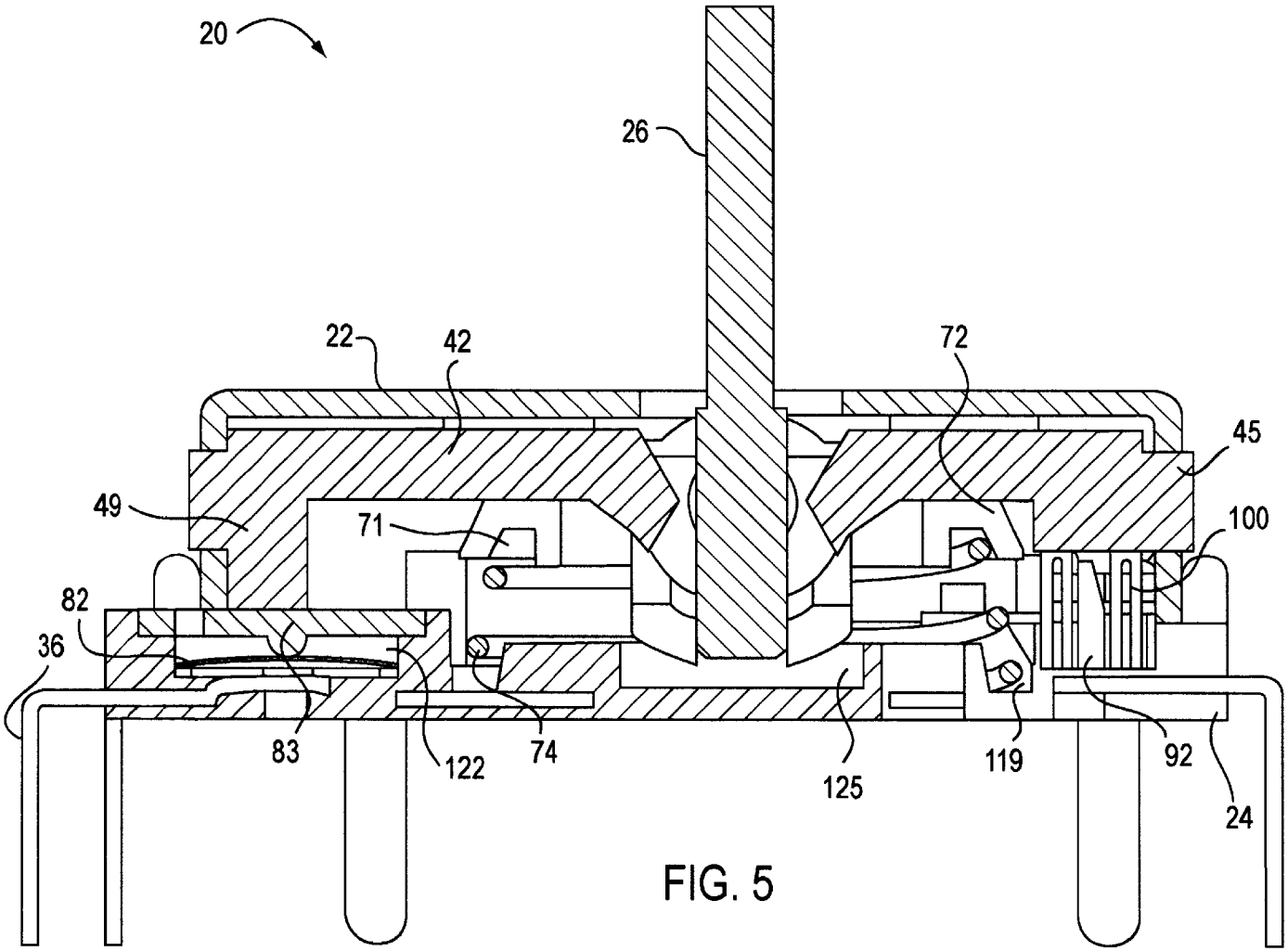
FIG. 5 is a cross-sectional view of FIG. 1
Figure 6:
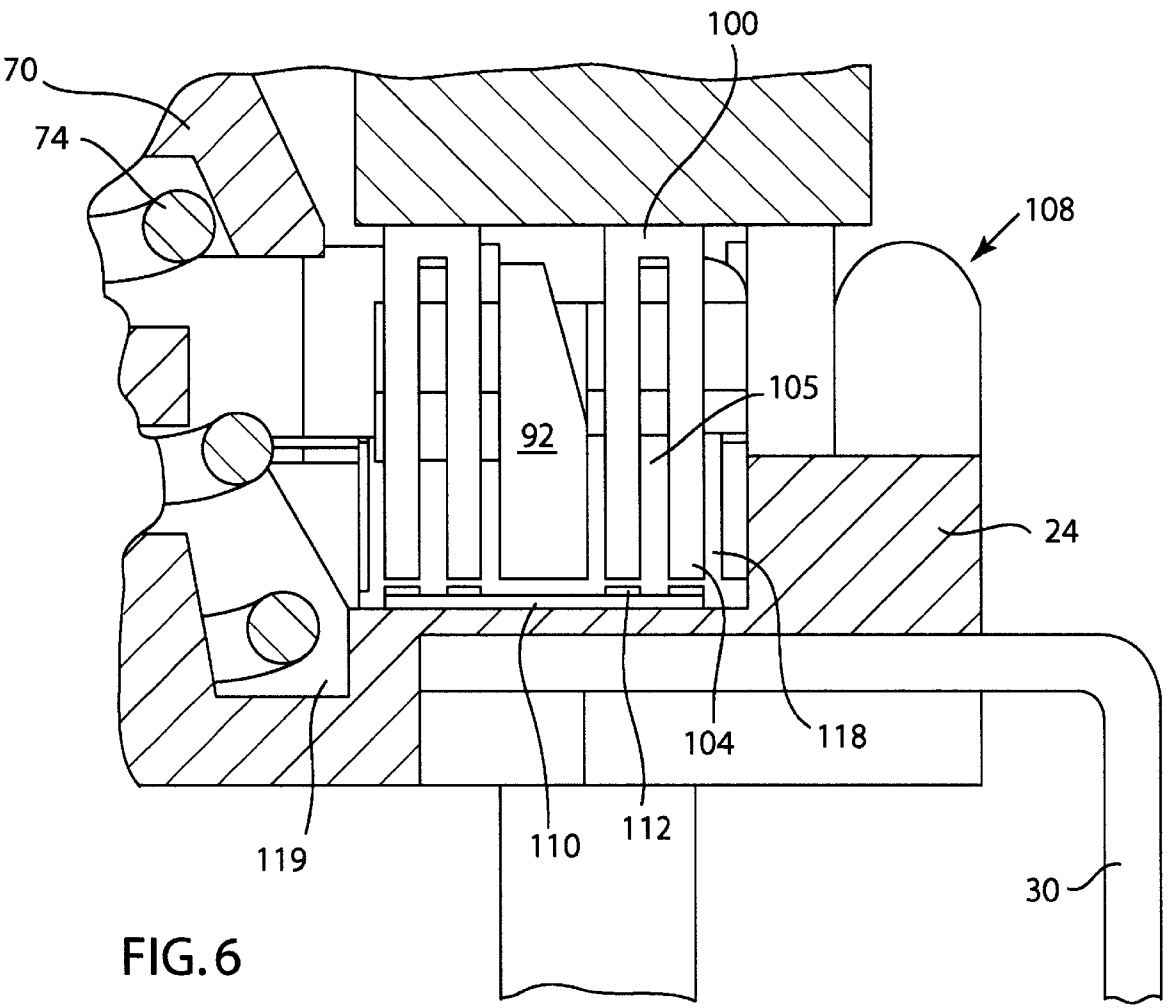
FIG. 6 is a partial cross-sectional view of FIG. 1.
Figure 7:
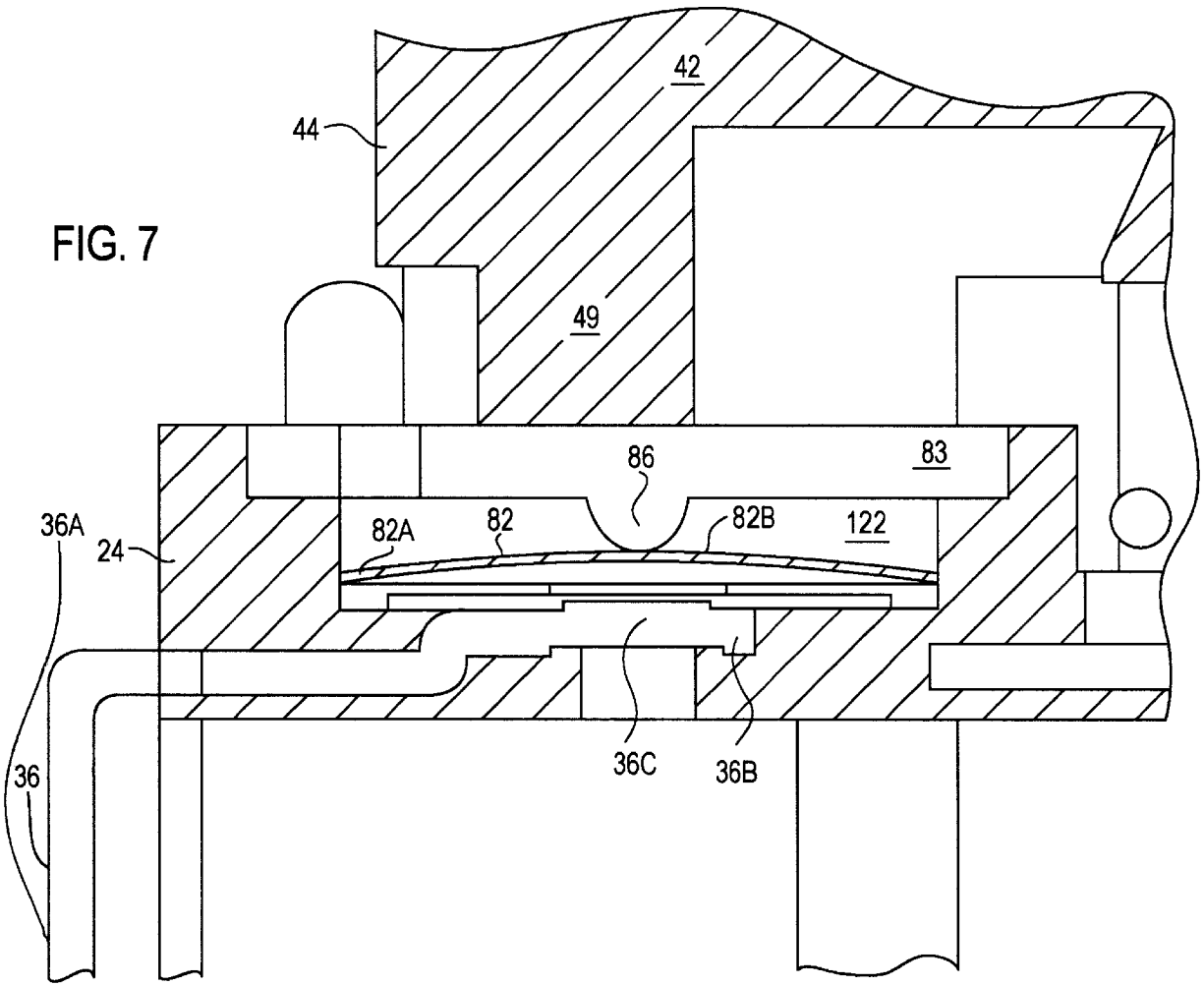
FIG. 7 is another partial cross-sectional view of FIG. 1.

Referring to FIGS. 1–7, there is a joystick and switch 20 that can, for example, be used to control the movement of a cursor on a computer screen (not shown). The joystick 20 is made up of a base 24, cover 22, stick 26, gimbal 40, flexible film 110, wiper 100 and switch 80.

Cover 22 has several pins 28 and holes 23. Cover 22 is mounted over base 24. An aperture 25 allows stick 26 to pass through cover 22. Base 24 has a recess 118, a groove 119, a slot 120, a bottom surface 121, a cavity 122, posts 123, slot 124, cavity 125 and terminals 30 and 36. Cover 22 is preferably stamped metal and base 24 is preferably formed from injection molded plastic. A stick 26 has ends 26A and 26B. End 26B is attached to a gimbal 40.

Gimbal 40 has an upper yoke 42, and a lower yoke 64. Upper yoke 42 has ends 44 and 45. Each yoke end has opposed projections 46 extending outwardly. Each projection 46 has a post 47. Yoke 42 has four tabs 48 that are centered about a slot 50 in the center of the yoke. A hole 52 passes through yoke 42. Similarly, lower yoke 60 has ends 62 and 63. Each yoke end has opposed projections 64 extending outwardly. Each projection 64 has a post 65. Yoke 60 has four tabs 66 that are centered about a slot 67 in a U-shaped center section 68. Stick 26 is pivotally coupled to gimbal 40 by press fitting end 26B through slots 50 and 67. After assembly, ends 45 and 63 are rotatably supported in holes 23.

Washer 70 has a recessed raceway 71 and a hole 72. Washer 70 resides under lower yoke 60. A spring 74 is located in raceway 71 and extends into groove 119. Spring 74 biases washer 70 toward yoke 60.

Switch 80 has a metal dome 82 and an actuator 83. Actuator 83 has a disc 84 that is defined by a slot 85. A bump 86 extends from disc 84. Actuator 83 is formed from plastic. Switch 80 is mounted in cavity 122. Dome 82 has an outer edge 82A that is placed over a terminal end 34. A center portion 82B of dome 82 is mounted over the contact portion 36C of pin 36 adjacent to end 36B. The switch is activated when stick 26 rotates yoke 60 sufficiently so as to cause boss 49 to contact disc 84. Disc 84 is bent downward which causes dome 82 to collapse and to contact portion 36C thus completing an electrical circuit between terminal end 34 and contact portion 36C.

A pair of wipers 100 are mounted to projections 45 and 63. Wiper 100 has a blade 102, a cutout 103, a contactor 104 and a slot 105. Wipers 100 are mounted by sliding blades 102 over posts 47 and 65. After mounting, posts 47 and 65 are located in cutouts 103. Flexible film 110 is mounted in recess 118. Flexible film is preferably a Kapton film. Flexible film 110 has resistors 112 mounted on a curved upper portion. Conductors 114 connect to each end of resistors 112. Conductors 114 surround an aperture 116. Resistors 112 and conductors 114 are conventional polymer conductors and resistors. Contactor 104 slides along and is in electrical contact with resistor 112. Wiper 100 and flexible film 100 form a variable resistor or potentiometer 108. Aperture 116 is mounted over terminal end 34 and is electrically connected to terminal end 34 by either soldering or crimping. A terminal end 32 would be inserted into another printed circuit board (not shown) where it would be electrically connected to an electrical device or circuit such as a computer or controller.

A retainer block 90 is mounted over flexible film 100. Retainer block 90 has a finger 91, a post 92 and ends 93 and 94. Finger 91 snaps into slot 120 to retain block 90 to base 24. Post 92 is located in slot 105 of wiper 100 and separates contactors 104. Ends 93 and 94 are mounted over conductors 114 and apertures 116 and help to retain flexible film 110 in recess 118.

Variable resistor 108 allows the sensing of the rotational position of each yoke 42 and 60. A voltage is applied between two of terminals 30 that are connected to resistors 112. As yokes 42 and 60 move, contactor 104 moves on resistor 110 and the voltage between the two terminals 30 changes. Thus, the output voltage between two of terminals 30 that are connected to resistor 112 is proportional to the position of the yoke. Because stick 26 is attached to the yoke, the voltage is also proportional to the position of the stick 26.

The stick 10 is shown in a centered or centering position. That is, a position that has stick 26 in a vertical position that allows the shaft to be moved an equal and maximum distance in all directions perpendicular to the shaft. The spring 74 forces washer 70 against yokes 42 and 60. This forces the stick 26 into a vertical centered position. When stick 26 is moved off center, tabs 66 and 48 contact washer 70, which presses washer 70 downwardly. Since washer 70 is biased by spring 74, the user pressing on stick 26 feels a feedback force. Also, once the user releases stick 26 washer 70 pressing on tabs 48 and 66 urges stick 26 back into a centering position.

One of ordinary skill in the art of designing joysticks will realize many advantages from using the preferred embodiment. In particular, joystick and switch 20 have a low height or profile due to the mounting of variable resistors 108. Further, the integration of switch 80 within the base 24 leads to an overall compact package size. Specifically, by placing switch 80 inside there is eliminated the extra space that would have been used if switch 80 were to be placed on the outside base 24.

Although the invention has been taught with specific reference to these embodiments, someone skilled in the art will recognize that many other changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A joystick, comprising:

a) abase;

b) a cover mounted over the base;

c) a stick having a first end extending from the cover and a second end;

d) a gimbal having the second end of the stick mounted thereto, the gimbal located above the base, the gimbal having a first and second yoke coupled to the stick for allowing the stick to move, the yokes each having a first and second end;

e) a pair of wipers, mounted to the first ends of the yokes;

f) a pair of resistors positioned between the wipers and the base, the resistors adapted to generate an electrical output signal indicative of a position of the stick when a voltage is applied to the resistors;

g) a plurality of terminals mounted to the base, a first portion of the terminals electrically connected to the resistors; and h) a switch, positioned in the base below the second end of the first yoke, the switch activated when the first yoke is sufficiently rotated so as to cause the second end of the first yoke to contact the switch and to close the switch, the switch electrically connected to a second portion of the terminals.

2. The joystick of claim 1, wherein the resistors are mounted to a flexible film.

3. The joystick of claim 2, wherein the flexible film is mounted in a recess in the base.

4. The joystick of claim 1, wherein the switch is mounted in a cavity in the base.

5. The joystick of claim 1, wherein the first yoke is mounted over the second yoke.

6. The joystick of claim 5, wherein a spring is mounted between the second yoke and the base, the spring forcing the joystick into a centering position.

7. The joystick of claim 6, wherein a washer is mounted between the second yoke and the spring.

8. The joystick of claim 3, wherein a retainer block is mounted over a portion of the flexible film, the retainer block being attached to the base.

9. The joystick of claim 1, wherein the first end of the yokes has an opposing pair of projections, the wipers slidably attached to the projections.

10. The joystick of claim 1, wherein each of the yokes have an opposing pair of tabs, the tabs contacting the washer in an alternating manner when the stick is moved off a center position, the washer not being in contact with the tabs when in the center position, the washer contacting the tabs when not in the center position, the spring biasing the washer toward the tabs such that the stick returns to the center position when not being depressed.

11. The joystick of claim 8, wherein the wiper is bifurcated and the retainer block has a finger extending from the retainer block through the bifurcated wiper.

12. The joystick of claim 2, wherein the flexible film has an aperture, the aperture being mounted over an end of the terminal.

13. The joystick of claim 12, wherein the end of the terminal is compressed over the aperture.

14. The joystick of claim 1, wherein the stick is press-fit into a slot in the first yoke.

15. A joystick, comprising:

a) a base having a cavity and at least one recess;

b) a cover mounted over the base;

c) a stick having a first end extending from the cover and a second end;

d) a first and second yoke, the second end of the stick attached to the first yoke, the yokes each having a first and second end;

e) at least one wiper, the wiper mounted to the first ends of the yokes;

f) a flexible film positioned in the recess;

g) at least one resistor positioned on the flexible film, the resistor adjacent to and in contact with the wiper and the base, the resistor adapted to generate an electrical output signal indicative of a position of the stick when a voltage is applied to the resistor; and h) a plurality of terminals mounted to the base, a first portion of the terminals electrically connected to the resistors.

16. The joystick of claim 15, wherein a switch is mounted in the cavity, below the second end of the first yoke, the switch activated when the first yoke is sufficiently rotated so as to cause the second end of the first yoke to contact the switch and to close the switch, the switch electrically connected to a second portion of the terminals.

17. The joystick of claim 15 wherein the first yoke is mounted over the second yoke.

18. The joystick of claim 15, wherein a spring is mounted between the second yoke and the base, the spring forcing the joystick into a centering position.

19. The joystick of claim 18, wherein a washer is mounted between the second yoke and the spring.

20. The joystick of claim 15, wherein a retainer block is mounted over a portion of the flexible film, the retainer block being attached to the base.

21. The joystick of claim 15, wherein the first end of the yokes has an opposing pair of projections, the wipers slidably attached to the projections.

22. The joystick of claim 15, wherein each of the yokes have an opposing pair of tabs, the tabs contacting the washer in an alternating manner when the stick is moved off a center position, the washer not being in contact with the tabs when in the center position, the washer contacting the tabs when not in the center position, the spring biasing the washer toward the tabs such that the stick returns to the center position when not being depressed.

23. The joystick of claim 20, wherein the wiper is bifurcated and the retainer block has a finger extending from the retainer block through the bifurcated wiper.

24. The joystick of claim 15, wherein the flexible film has an aperture, the aperture being mounted over an end of the terminal.

25. The joystick of claim 24, wherein the end of the terminal is compressed over the aperture.

26. The joystick of claim 15, wherein the stick is press-fit into a slot in the first yoke.

* * * * *